United States Patent [19]

Lebonvallet

[11] Patent Number: 4,668,285

[45] Date of Patent: May 26, 1987

[54] PROCESS AND INSTALLATION FOR THE CONTINUOUS CONTROL OF A BLAST-FURNACE

[75] Inventor: Jean-Louis Lebonvallet, Maisons, France

[73] Assignee: Usinor, Puteaux, France

[21] Appl. No.: 788,808

[22] Filed: Oct. 18, 1985

[30] Foreign Application Priority Data

Oct. 19, 1984 [FR] France ..... 84 16082

[51] Int. Cl.[4] ..... C21B 5/00; C21B 7/24

[52] U.S. Cl. ..... 75/41; 266/79; 266/80; 266/89

[58] Field of Search ..... 75/41, 42; 266/79, 80, 266/89

[56] References Cited

U.S. PATENT DOCUMENTS

| | | | |
|---|---|---|---|
| 2,625,386 | 1/1953 | Leone | 75/41 |
| 3,359,784 | 12/1967 | Jorre et al. . | |
| 3,690,632 | 9/1972 | Munson | 266/197 |
| 4,040,789 | 8/1977 | Voss | 266/80 |
| 4,509,727 | 4/1985 | Davis | 75/41 |

FOREIGN PATENT DOCUMENTS

| | | | |
|---|---|---|---|
| 684114 | 11/1939 | Fed. Rep. of Germany . | |
| 1583176 | 7/1970 | Fed. Rep. of Germany . | |
| 535528 | 4/1922 | France . | |
| 49-20693 | 5/1974 | Japan | 266/79 |
| 61179 | 8/1970 | Luxembourg . | |
| 1238882 | 7/1971 | United Kingdom . | |

OTHER PUBLICATIONS

110 Stahl und Eisen No. 15, Aug. 1983, pp. 45–50.

*Primary Examiner*—Melvyn J. Andrews

[57] ABSTRACT

This process and this installation permit taking samples of blast-furnace gas from a series of orifices (T1, T2 . . . ) located at different levels along a generatrix of the body of the blast-furnace. There are performed, in sequence, operations for preparing sampling lines, operations for the analysis of the gases in a device (G), and pressure measuring operations in a pressure sensor (P). These various operations are managed by a programmable automaton (A) and the data obtained are used in a computer (C) in accordance with an embodiment of the installation.

18 Claims, 6 Drawing Figures

PROCESS AND INSTALLATION FOR THE CONTINUOUS CONTROL OF A BLAST-FURNACE

The present invention relates to processes and installations for controlling the operation of blast-furnaces.

It is known that it is important to know the conditions of operation of a blast-furnace so as to obtain an optimum yield and to be in a position to regulate the composition and the quality of the metal produced by correctly regulating the introduction of the various elements in the blast-furnace. Thus, it is important to know the composition of the gases in the vessel in order to deduce the state of advancement of the reduction of the iron oxides. The pressure conditions prevailing inside the blast-furnace must also be known and data concerning its thermal state must be available for regulating in consequence the amount of coke introduced through the throat.

Various attempts have been made to improve this knowledge:

There has thus been effected a vertical probing or examination by means of a tube which descends into the blast-furnace at the same time as the charge and whereby the pressure, the temperature and the analysis of the gases are determined. However, such a probing can only be effected during a testing procedure and is not practicable in normal operation. Further, it concerns a destructive test which only provides information over a relatively short period of operation of the blast-furnace corresponding to a complete descent of the charge, i.e. during a period on the order of a few hours.

Probings or examinations have been effected by means of a tube at a given level of the blast-furnace, for example in the upper two thirds of the height of the shaft of the blast-furnace. Such a tube enables measurements to be taken over a period of a few weeks and has been employed, in particular, for measuring temperature.

Horizontal probings have also been effected along a radius of the shaft. These concern localized measurements taken in an instananeous manner in the charge and permit the obtainment of data concerning the temperature and the composition of the gases. However, such a procedure provides only quite partial and uncertain results since the frequency at which the measurements are carried out is low, for example every eight hours. Moreover, the equipment used for effecting these probings is subjected to an extremely agressive environment and must be frequently replaced.

It is recalled that continuous measurements have also been effected at a given level by maintaining in position in the blast-furnace a girder of large size, such an installation being mainly employed for providing measurements of temperature.

It is also known to carry out measurements of pressure along one or more generatrices of the shaft, these measurements providing however only very partial data concerning the operation of the blast-furnace.

An object of the invention is consequently to provide a process and an installation which permit the obtainment of data which is as complete as possible concerning the operation of a blast-furnace, this installation being moreover reliable and particularly convenient to use.

The invention therefore provides a process for controlling the operation of a blast-furnace comprising sampling in succession gases from a plurality of orifices spaced apart on the height of the wall of the blast-furnace, effecting an analysis for determining the content of these gases or at least of some of their constituents, and measuring the pressure of these gases, these operations being repeated over a significant period of operation of the blast-furnace.

According to other features of this process:

prior to the analysis proper, there is effected a preparation of the line corresponding to the orifice in respect of which the analysis will be made, and these successive preparation and analysis operations are priority operations relative to the measurements of pressure;

there are effected simultaneously an analysis operation on a line corresponding to an orifice of a given row n and a preparation operation on a line corresponding to an orifice of row $n+1$;

a re-standardization of the analysis device is periodically effected.

The invention also provides an installation for carrying out this process, which comprises a series of sampling orifices provided at different levels in the wall of the blast-furnace; a gas analysis circuit extending from each sampling orifice and connected to a gas analysis device; a pressure measuring circuit extending from each sampling orifice and connected to a pressure measuring device; a control device for determining at each instant which of the sampling orifices must be connected to the analysis device and to the pressure measuring device; and means for processing the data thus obtained.

According to other features of this installation:

the sampling orifices are arranged along at least one generatrix of the blast-furnace;

the sampling circuits are grouped into two sub-assemblies, the conduits of a given sub-assembly being connected to the same manifold, and the manifolds being connected, through respective conduits under the control of a valve, to the analysis device;

it includes means connecting each sampling conduit to a network of neutral gas under pressure for effecting a purge in this conduit before each analysis operation;

the pressure measuring circuit comprises a sampling conduit leading from each sampling orifice, controlled by a valve, and connected through a main conduit to the pressure measuring device.

The invention will be described in more detail with reference to the accompanying drawings which are given solely by way of example and in which.

Figure 1:
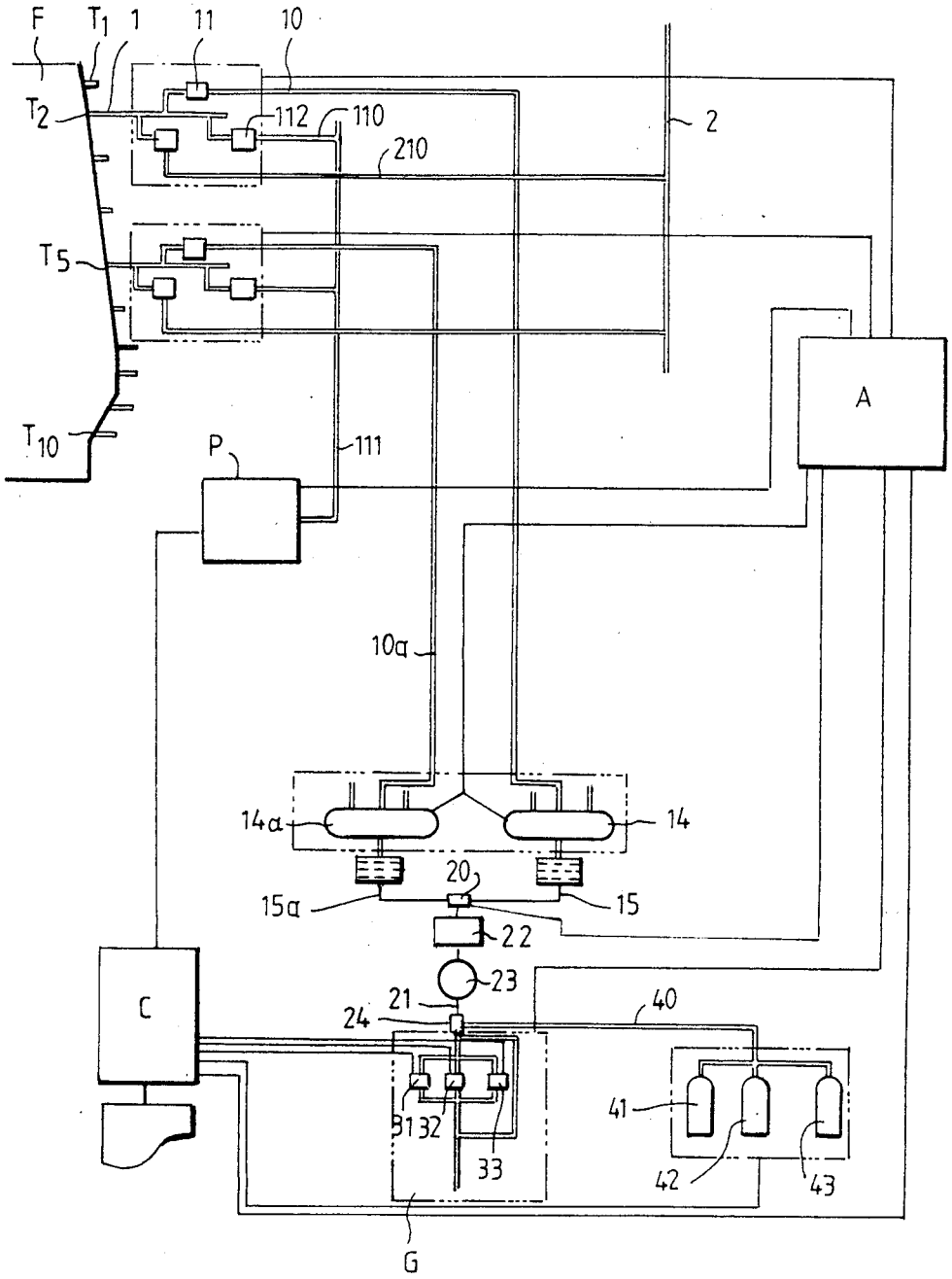
FIG. 1 is an assembly diagram of the installation according to the invention.

The installation diagrammatically illustrated in FIG. 1 comprises: a blast-furnace F in the wall of which is formed a series of sampling or take-off orifices (T1, T2, . . . ) preferably arranged along a generatrix and at different levels. Preferably, between six and ten sampling orifices are provided along the height of the blast-furnace. In the embodiment described and shown in the drawing, these orifices are arranged in two categories, the orifices of an even row (T2, T4, . . . ) and the orifices of an odd row (T1, T3, . . . ). The diagram of FIG. 1 only shows the circuits associated with an even orifice T2 and an odd orifice T5.

Associated with each orifice is a gas sampling and analysis circuit and pressure sampling and measuring circuit. The gas sampling and analysis circuits of all the even orifices are connected to a common manifold while the gas sampling and analysis circuits associated with the odd orifices are connected to a second common manifold. These two manifolds are connected to a common gas analysis device 6.

The pressure sampling and measuring devices associated with the various orifices are connected to a common pressure measuring device P.

The installation is completed by a network 2 of gas under pressure, in the present instant a network of nitrogen, whose function will be explained hereinafter, and a control device comprising, in the presently-described embodiment a programmable automaton A which may be for example an automaton of type PB6 of the firm MERLIN-GERIN, and a computer C, for example a computer in the configuration in which it comprises a central memory of 64 K.octets, a read and write memory constituted by two discs each having a capacity of 10 million octets, this computer being provided with analog inputs (for example 96) and digital inputs (for example 32) and the usual peripherals such as the keyboards-monitors and printers.

Figure 2:
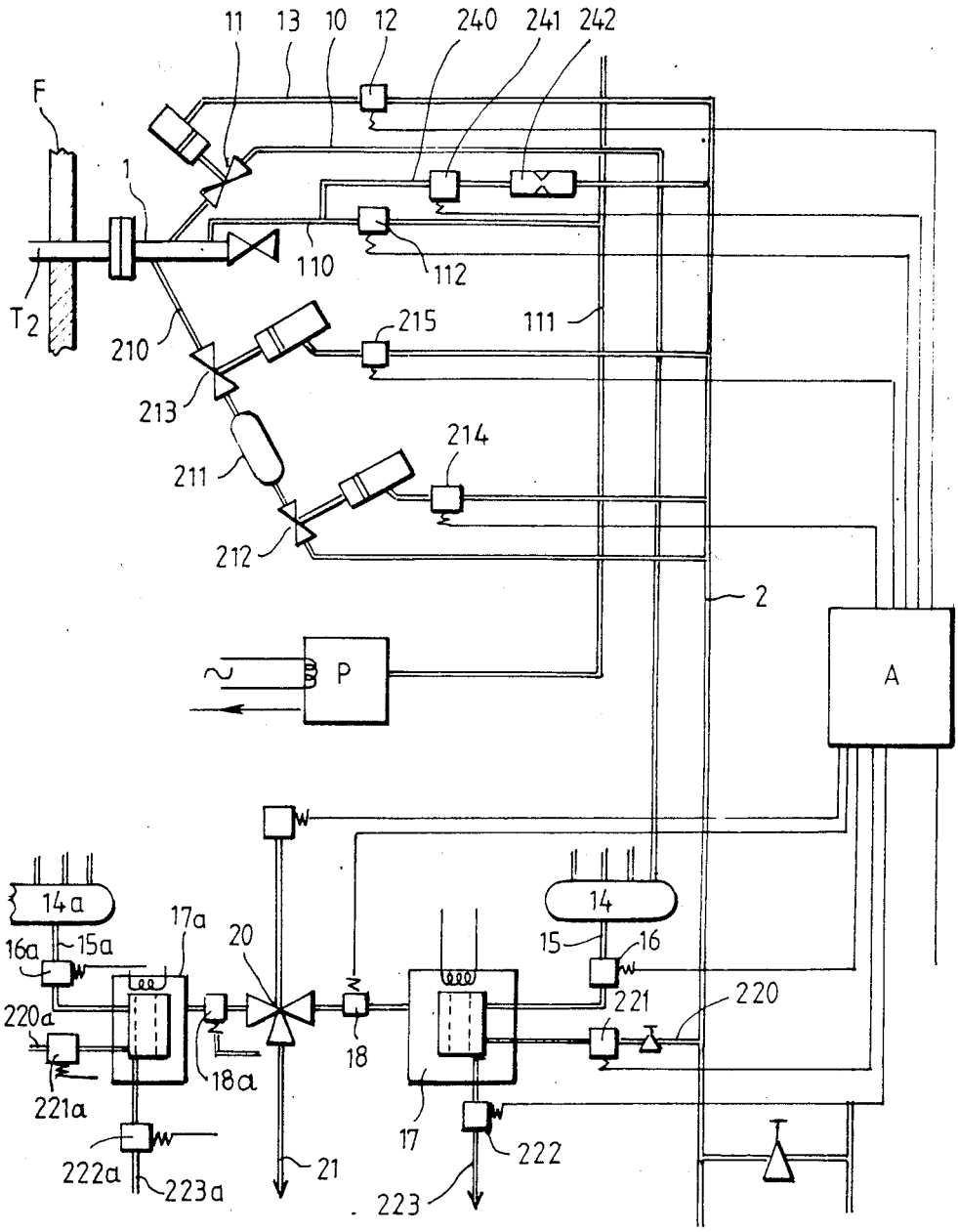
FIGS. 2 and 3 are diagrammatic more detailed views of this installation.

The installation will be described more precisely with reference to FIGS. 2 and 3 which represent the circuits associated with the sampling orifice T2, it being understood that the circuits corresponding to the different orifices are identical.

Extending from the orifice T2 formed in the wall or armor of the blast-furnace F is a conduit 1 to which are connected sampling conduits 10 and 110, for the analysis and pressure measurement respectively.

Provided in the analysis sampling conduit 10 is a hydraulically controlled valve 11 piloted by an electro-valve 12 which is controlled by the programmable automaton A and placed in a conduit 13 supplying gas under pressure. The conduit 10 is connected to a manifold 14 with which communicate all the conduits such as 10 extending from even sampling orifices. The manifold 14 is connected, through a conduit 15 and under the control of an electro-valve 16, to a filter 17 preferably provided with each means. Located on the downstream side of the filter 17 is an electrically operated valve 18 and a three-way valve 20 controlled, as the valve 16 and the valve 18, by the automaton A.

Figure 3:
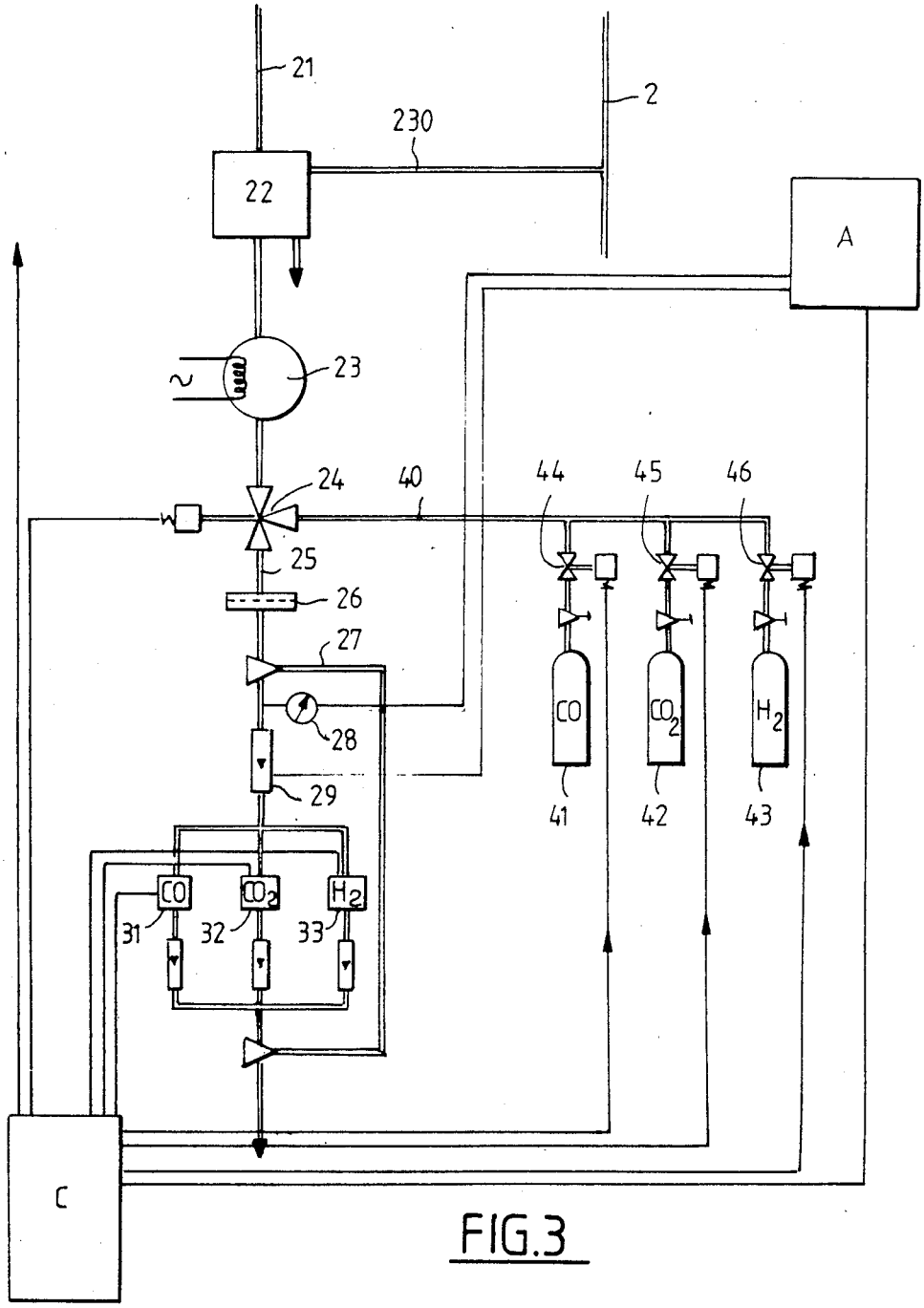

Another way of this valve 20 is connected through a conduit 15*a* to a manifold 14*a* associated with the odd row orifices through means identical to those described for the manifold 14 and designated by the same reference characters to which the index a has been added, while the third way of this valve is connected through a conduit 21 to the gas analysis device G through a drier 22 and a pump 23 (FIG. 3). The gas conduits upstream of the drier are heated so as to avoid condensations under cold conditions.

The gas analysis device is controlled by a three-way electrically operated valve 24 controlled by the computer C. The three ways of this valve are respectively connected as follows: one way to the conduit 21, the second way to a conduit 25 connected to three elementary devices 31, 32, 33 for measuring the content CO, $CO_2$ and $H_2$ through a filter 26, a flow regulator 27, a pressure sensor 28 and a flow meter 29. The three elementary analysis devices are connected to the computer C while the pressure sensor 28 and the flow meter 29 deliver their informations to the automaton A.

A third way of the valve 24 is connected through a conduit 40 to three standard gas cylinders 41, 42, 43 respectively containing CO, $CO_2$ and $H_2$, the communication between these three cylinders and the conduit 40 being achieved under the control of three electrically operated valves 44, 45, 46 controlled by the computer C.

The pressure measuring circuit (FIG. 2) is very simple and comprises a conduit 110 extending from the conduit 1 and connected to a main conduit 111 which is connected to a pressure sensor P of any known type. The pressure sensor is itself connected to the computer. The conduit 110 is controlled by an electrically operated valve 112 actuated by the automaton A.

The installation is completed by purging and other means connected to the network 2 supplying nitrogen under pressure. Thus, there is connected to the conduit 1 a conduit 210 in which are inserted a chamber 211 and two valves 212 and 213 located on each side of the chamber 211. These two valves are pneumatic valves controlled by electrically operated valves 214, 215 which are actuated by the automaton A.

The filter 17 (as the filter 17*a*) is provided with cleaning means formed by a conduit 220, 220*a*, connected to the network 2 through an electrically operated valve 221, 221*a*, a second electrically operated valve 222, 222*a* being inserted in a second conduit 223, 223*a* leading from the filter 17 (17*a*).

Likewise, the drier 22 is connected to the nitrogen network through a conduit 230.

Connected between the conduit 1 and the valve 112 to the conduit 210 is a conduit 240 connected to the nitrogen network 2 under the control of an electrically operated valve 241 controlled by the automaton A. A flow controller 242 is inserted in this conduit 240.

Figure 4:
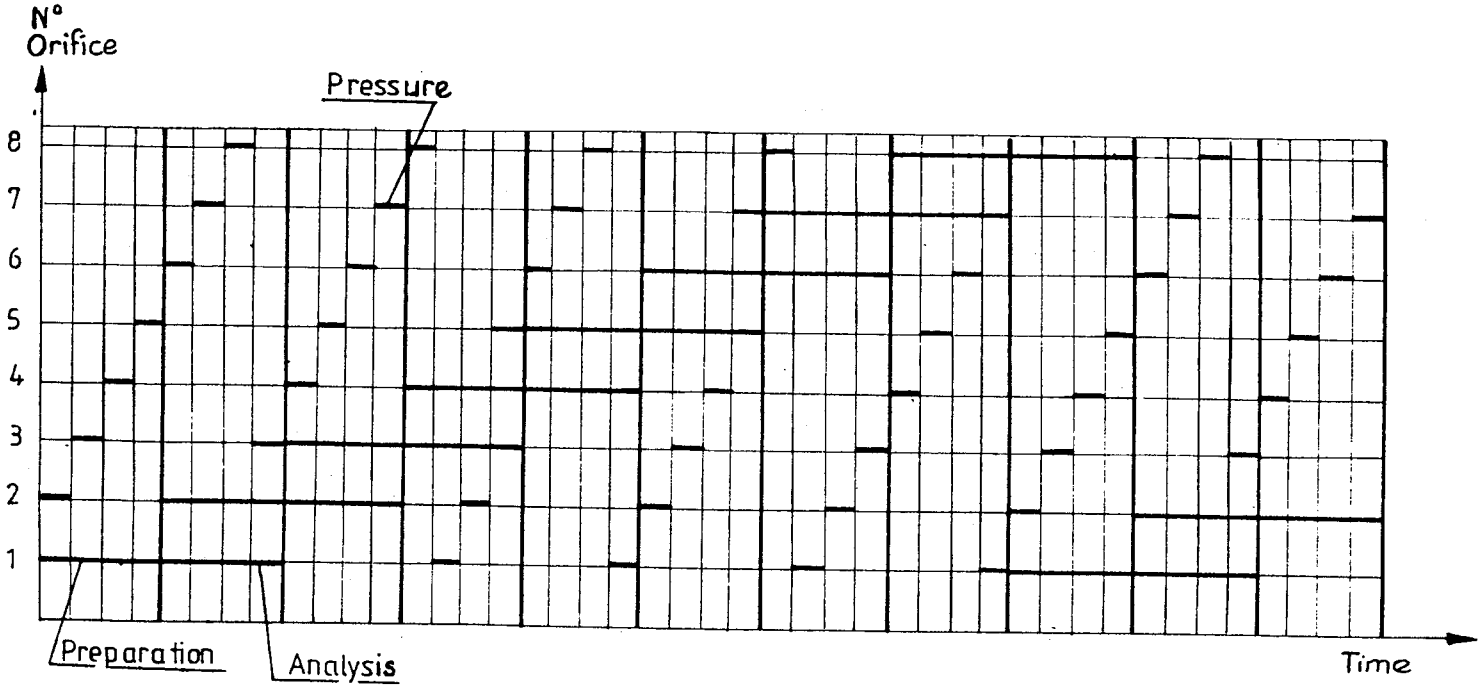
FIG. 4 is a diagrammatic illustration of a sequence of operations for the various sampling orifices.
Figure 5:
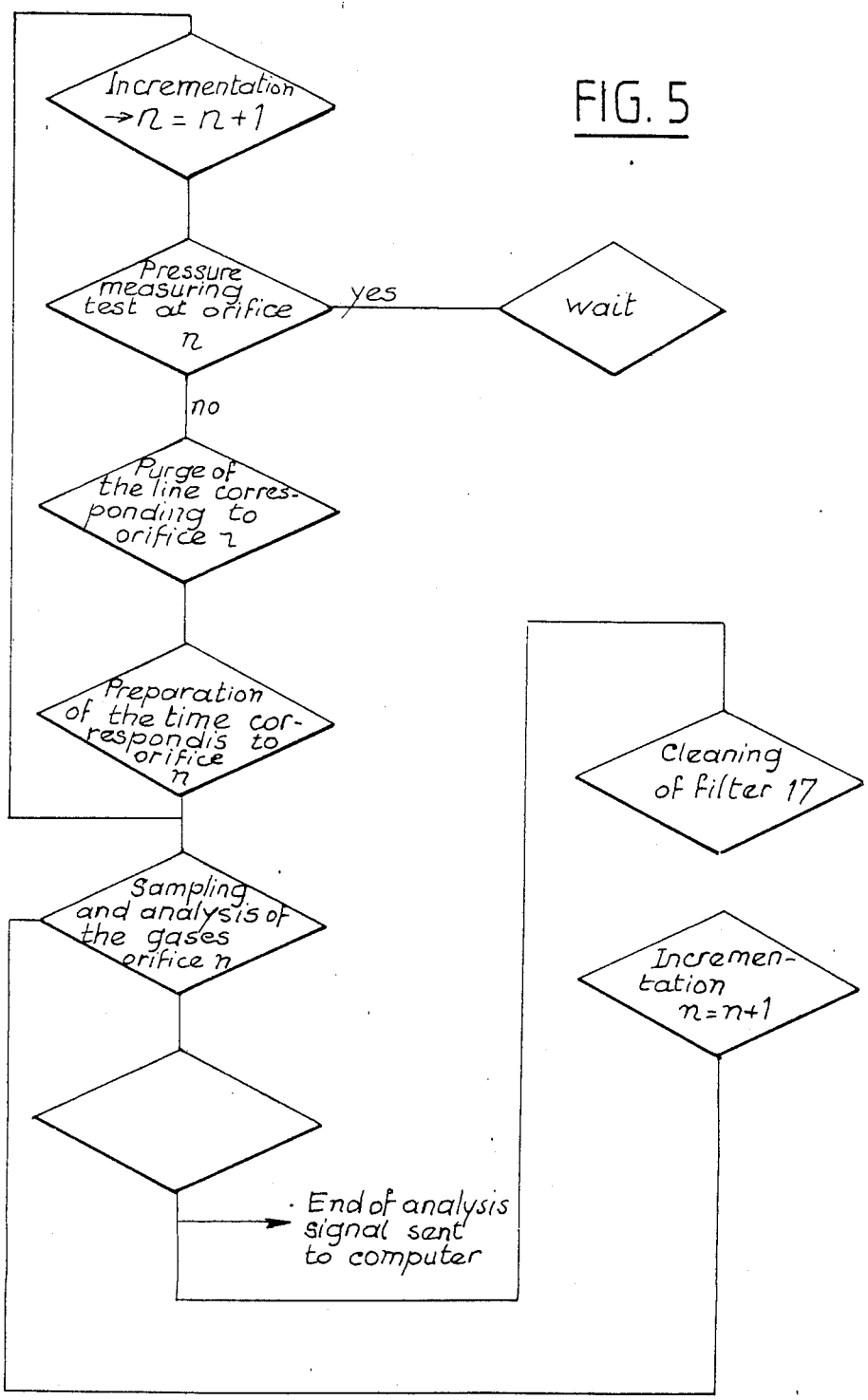
FIG. 5 is a process chart illustrating a gas sampling and analysis sequence.
Figure 6:
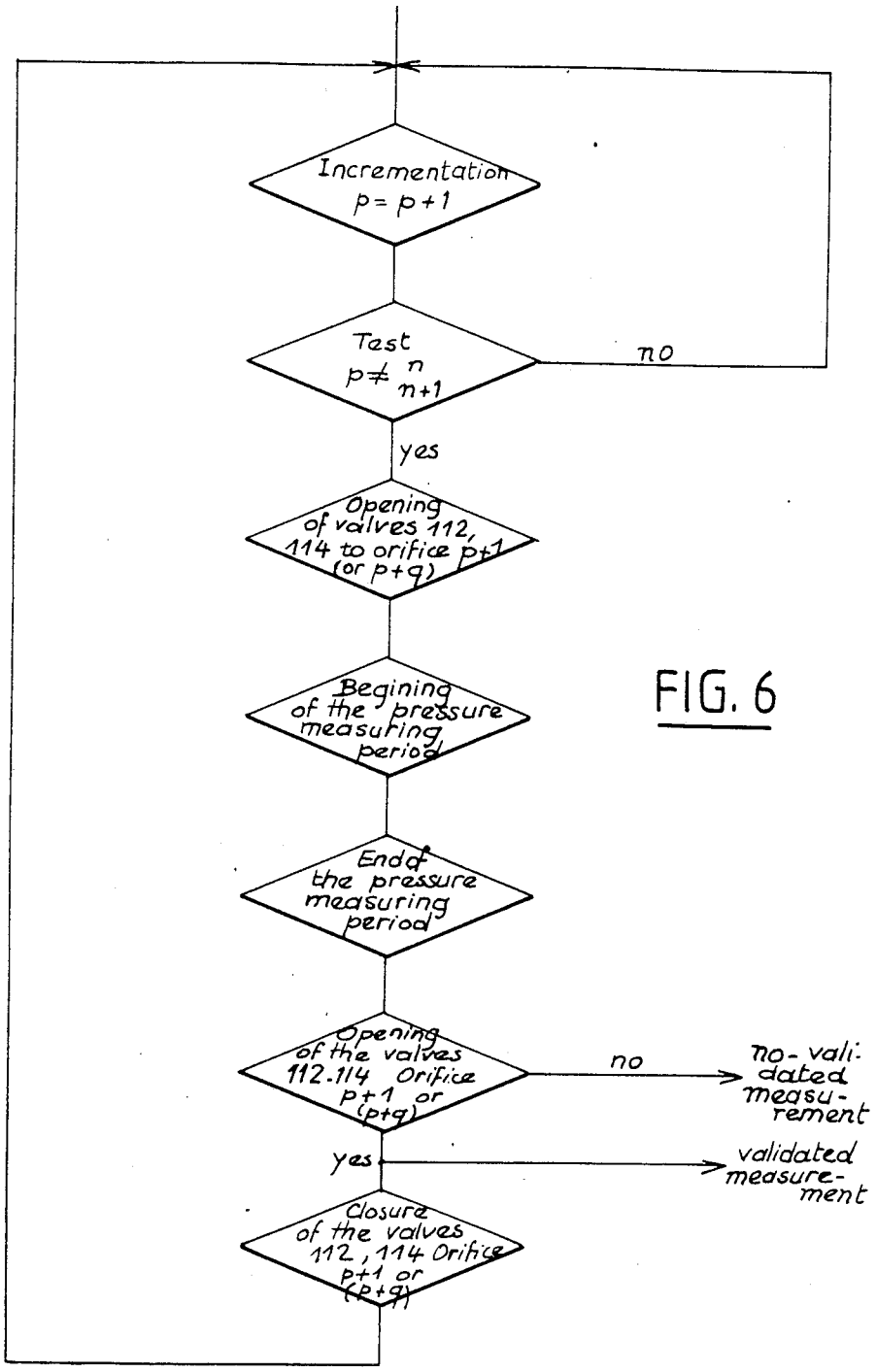
FIG. 6 is a process chart illustrating a sampling and pressure measuring sequence.

A complete cycle of operation of this installation will now be described with reference to, on one hand, the diagrams of FIGS. 2 and 3 with reference to which this installation has been described and, on the other hand, flow charts of FIGS. 4 to 6.

Note first of all that the analysing operations are sub-divided into two series of operations: first of all, a stage for preparing the sampling and analysis circuit corresponding to a given sampling orifice, then an analysis stage proper. Each of these two stages has, for example, a duration on the order of 2 to 3 minutes. Bearing in mind the duration of a pressure measuring stage is substantially shorter, for example on the order of 30 seconds, the preparation and analysis operations are considered to be priority operations with respect to the pressure measuring operations. This is diagrammatically represented in FIG. 4 in which is shown for an installation having eight sampling orifices, the succession of preparation, analysis and pressure measuring operations. It can be seen, in this diagram, that the pressure measuring operations are carried out on free orifices, i.e. on those in respect of which no preparation or analysis operation is being effected. Note also that while an analysis operation is being effected on a given orifice, there are simultaneously effected on the orifice of the immediately higher row the preparation operations preceding the analysis. The management of the successive operations is effected by the programmable automaton.

The description of the operation will be pursued by studying in succession a complete preparation and analysis cycle and then a pressure measuring cycle.

PREPARATION AND ANALYSIS CYCLE (FIGS. 2, 3, 4 and 5)

It will be assumed that the initial situation corresponds to that in respect of which has just terminated a preparation cycle for an orifice of row n−1, n−1 being for example an odd number.

The automaton effects an incrementation operation for passing, for the preparation, to the orifice of the immediately higher row, that is, the orifice of row n while there the analysis operation will be effected on the orifice n−1. It will be understood that, when n reaches the maximum prescribed value, n max, the incrementation operation returns it to the value 1.

The automaton then proceeds to a test for determining whether a pressure measuring operation is being carried out on the orifice of row n. If such is the case, it introduces a waiting period which may be equal to the duration of the pressure measuring operation, i.e. for example 30 seconds. On the other hand, if no pressure measuring operation is being effected on the designated orifice, the automaton initiates the start of the stage for preparing the orifice n, which comprises in fact two essential operations: an operation for purging the pipes and an operation for preparing the line.

The operation for purging the conduit 1 is carried out by opening the valve 212 controlled by the valve 214 in such manner as to fill the chamber 211 with nitrogen. A certain period of time is allowed to elapse, for example 5 sec, for filling this chamber. The valve 212 is then closed and the valve 213 controlled by the valve 215 is opened. The chamber 211 is then emptied into the sampling tube 1 and a certain period of time, for example 5 sec, is allowed to elapse so as to complete the purging. The valve 212 is then closed and the chamber 211 is once again isolated.

The operations for preparing the line are effected by closing the valve 18 and opening the valve 222, the valve 221 being closed, so as to establish a path through the filter 17 toward the purge conduit 223. The valve 11 controlled by the valve 12 is then opened and the valve 16 between the manifold 14 and the filter 17 is opened. The final path thus extablished remains open for a certain period of time sufficient to allow the establishment of an even rate of flow of the gases from the orifice Tn.

During these operations for preparing the line, for sampling and analysis corresponding to the orifice of row n, the stage for the analysis of the gases sampled through the orifice n−1 was occurring. At the end of the operation for the analysis of the orifice n−1 and of the stage for preparing the orifice n, the electrically operated valve 20 is actuated in such manner as to close the communication between the conduits 15*a* and 21 and to open the communication between the conduits 16 and 21. The valve 222 is closed and the valve 18 opened, the valve 221 remaining closed.

In this way, there is established the path of the gases toward the analysis device G and this path remains established throughout the period required which may be for example between 2 and 3 min.

At the end of the gas analysis cycle, there is initiated an operation for cleaning the filter 17 which comprises, after the closure of the valves 16, 18, opening the valves 221 and 222 to allow a current of nitrogen to pass through the filter 17. After a given period of time, which may be for example on the order of 20 sec, the valves 221 and 222 are closed.

When these analysis operations have been carried out, the computer C reads on the automaton the number of the orifice in respect of which these measurements have just been effected and the values delivered by the analysis device. This computer is for example so equipped and programmed as to store in its memory, for each orifice, the values of the analysis effected during a certain period of time, for example 4 hours. Further, again in respect of each orifice, the computer stores in its memory the number of analyses effected and the sum of the values of these analyses for each of the gases analysed during a given period of time, for example 2 hours. At the end of each period of 2 hours, the computer calculates the mean by dividing the sum of the measured values by the number of measurements effected. These mean values calculated for a period of 2 hours are stored in a file. Then the computer performs in the same way a calculation of the mean over a second period which may be, for example, 8 hours, and stored in a second file the values of the means corresponding to the periods of 8 hours. The computer performs in the same way a calculation of the mean values over a period of 24 hours and stores in a third file these mean values per period of 24 hours. These various operations for calculating the means and storage are easy to program for a person skilled in the art and it is therefore unnecessary to describe in detail the computer means required for performing these various operations.

The computer may also be programmed for effecting the automatic edition, for example once per day, of the means over a period of 2 hours, 8 hours and 24 hours. It is also possible for the user to edit as desired either the individual analyses retained during the last four hours, or the mean values every 2 hours, 8 hours or 24 hours.

The computer may be programmed for calculating from the measured values of the analyses in respect of CO, $CO_2$ and $H_2$, the nitrogen contents which are obtained by subtraction.

As concerns this sequence describing the gas analysis operations, it should be added that the computer C is required to initiate an operation for calibrating the analysis device during which the automaton A stops the sampling operations. This calibrating operation is carried out with a given period. To achieve it, the computer causes the shifting of the valve 24 for closing the communication between the conduit 21 and the conduit 25 and open the communication between the conduit 40 and the conduit 25 and the analysis device. Thereafter, the computer initiates in succession the opening of the valves 44, 45, 46 associated with the standard gas cylinders 41, 42, 43 and, when the rate of flow of gas from each of these cylinders is stabilized, there is effected a measurement, the measured value delivered by the analysis device is compared with a theoretical value stored in the memory of the computer and, according to the result of this comparison, the reference values with respect to which the measurements are effected in the analysis device are kept or modified. The sampling and analysis procedure is then resumed normally.

PRESSURE MEASURING CYCLE (FIGS. 2 AND 6)

As for the essential of the operations corresponding to an analysis cycle, most of the operations performed in the course of a pressure cycle are controlled by the automaton. It will be assumed that the initial situation is the following: an analysis is effected on the orifice of row n. The preparing operations are carried out simultaneously on the orifice of row n+1. As a pressure measurement has just been effected on an orifice of the row p, the automaton effects an incrementation operation p=p+1. Then it performs a test on the new value of p so as to check whether p is different from n and different from n+1, which is the row of orifices in which are being performed analysis and preparation operations. If this test is negative, the p=p+1 value is increment and the test of equality with n or n+1 is repeated. If this test is positive, the automaton causes the opening of the valves 112 and 241 corresponding to the orifice number p. The small flow of nitrogen established during this pressure measuring stage is adapted to avoid a stopping up of the pipes.

This opening of the valves associated with the chosen orifice determines the beginning of a pressure measuring period which may be for example 30 sec.

At the end of this pressure measuring period, the automaton checks the opening of the valves 212 and 214 so as to ascertain whether the circuit has in fact been placed in a state allowing a correct pressure measurement to be effected. This checking is carried out by means of position sensors with which the valves 112 and 114 are provided and which are connected to the automaton. If this checking is negative, the automaton decides that the measurement is not validated and does not deliver to the computer a signal allowing it to take this measurement into account. In the opposite case, the automaton delivers to the computer a validation signal and the computer then reads on the automaton the number of the orifice in respect of which the pressure measurement has just been made and on the pressure sensor P the value of the measurement effected.

In the same way as explained in respect of the analysis measurements, the computer performs a certain number of functions as concerns the processing of the data relating to the pressure measurements, to their storage and to their edition. Thus, the computer stores in its memory the values of the pressure measurements for each of the orifices during a period of time which may be, for example, 4 hours. Also, it estimates in respect of each orifice the number of measurements effected during a given period, for example 2 hours, and adds, in a suitable memory zone, the values measured during this period of 2 hours. At the end of each period of 2 hours, it calculates the mean, the mean values for the successive periods of 2 hours being stored in a first file.

The computer in the same way effects a calculation of the mean over a period of, for example, 8 hours and then over a period of 24 hours and keeps in a second and a third file these mean values corresponding to periods of 8 hours and 24 hours.

An automatic edition function in respect of the mean values for 2, 8 and 24 hours, may be provided. Further, the user may edit as desired either the individual values stored in the course of the last 4 hours, or the mean values corresponding to the periods of 2, 8 and 24 hours.

This mode of storage and processing which corresponds to simple operations for a person skilled in the art, may of course be replaced by any other operations as desired by the user.

The process and the installation just described permits the controlling with a very high efficiency of the operation of a blast-furnace in a continuous and precise manner. Indeed, the data received concern places spaced apart throughout the height of the blast-furnace, and thus permit knowing with very high precision the evolution of the metallurgical process within the blast-furnace, and in particular the evolution of the iron oxides, and therefore permits a modification of the manner in which this blast-furnace is operated.

Further, the means employed are extremely reliable, in particular bearing in mind the presence of means permitting a purging and a preparation of the various sampling lines by means of which the measurements are carried out. Participating in particular in this great reliability is the presence of the means for blowing nitrogen under pressure which avoids the stopping up of the pipes in the zone close to the sampling orifice.

The fact of grouping the sampling orifices in two series, for example an even and an odd row, permits the avoidance of a multiplication of the analysis devices and thereby saves precious time, since it is possible to proceed simultaneously to the preparation of the sampling line of one orifice and to the analysis on the sampling line of another orifice. Likewise, the pressure measuring sequence such as that described permits the obtainment with relatively simple and reliable means of the pressure measurements on the entire height of the blast-furnace.

The presence of calibration means controlled by the computer guarantees the reliability and the precision of the analyses carried out.

Further, in addition to its function of controlling the main operation of the installation, the automaton also supervises the good operation of this installation since it is connected to temperature, pressure and flow sensors etc . . . which, in the event of passing beyond certain threshold values, set off an alarm signal or stop certain parts of the installation.

It must be understood that the means described may be subject to many modifications. Thus, the functions performed by the automaton could also be effected by a specialized computer, the essential requirement concerning the functions fulfilled and the successive stages of the process. Further, any suitable type of driers, filters, pumps, analysis devices may of course be employed. Likewise, means may be provided for carrying out temperature measurements in given places of the blast-furnace and processing the result of these measurements.

What is claimed is:

1. A process for monitoring the operation of a blast-furnace in order to control the operation thereof, comprising:

sequentially sampling gases from a plurality of orifices spaced along the height of a wall of the blast-furnace, effecting a chemical analysis for determining the content of said gases in respect of at least certain constituents of said gases, and measuring the pressure of said gases, wherein the steps of sampling, effecting an analysis and measuring the pressure are repeated during a significant period of the operation of the blast-furnace.

2. A process according to claim 1, comprising the additional steps of preparing a sampling line leading from the orifice in respect of which the analysis is to be made prior to the step of effecting an analysis wherein said steps of preparing and effecting an analysis are priority operations relative to the step of measuring the pressure.

3. A process according to claim 2, wherein the step of preparing the sampling line, comprises the subsidiary steps of carrying out a purge by means of a neutral gas under pressure, at least in a zone in the neighbourhood of the orifice in respect of which the analysis is to be made, then establishing in the sampling line of that orifice an even flow of gas coming from the blast-furnace.

4. A process according to claim 1, wherein a plurality of spaced rows of orifices are provided on said blast-furnace wall and further comprising the steps of effecting simultaneously said step of analysis on a sampling line leading from an orifice of one row of orifices n, and preparing a sampling line leading from an orifice of another row of orifices n+1.

5. A process for carrying out the process according to claim 1, comprising the further step of periodically carrying out a calibration of an analysis device used for the step of effecting an analysis.

6. An installation for carrying out a process for controlling the operation of a blast-furnace, comprising sampling gases in succession from a plurality of orifices spaced along the height of the wall of the blast-furnace, effecting an analysis for determining the content of said gases in respect of at least certain of the constituents of said gases, and measuring the pressure of said gases, the operations of sampling, analysis and pressure measurement being repeated during a significant period of the operation of the blast-furnace, said installation comprising:

a blast furnace having a wall;

a series of sampling orifices provided at different heights on said wall of the blast-furnace, each sampling orifice being in fluid contact with a conduit;

a gas analysis circuit extending from each sampling orifice conduit and having one end in fluid contact with said respective sampling orifice;

a gas analysis device connected to an end of said gas analysis circuit opposed to said one end;

a pressure measuring circuit extending from each sampling orifice conduit and having one end in fluid contact with said respective sampling orifice;

a pressure measuring device connected to an end of said pressure measuring circuit opposed to said one end thereof;

a control device for determining at each instant which one of the sampling orifices must be connected to the analysis device and to the pressure measuring device; and, means for processing the data thus obtained.

7. An installation according to claim 6, wherein the sampling orifices are spaced apart along at least one generatrix of said wall of the blast-furnace.

8. An installation according to claim 6, further comprising a supply of neutral gas under pressure and means for connecting each sampling orifice conduit to said supply for effecting a purge in the sampling orifice conduit before each analysis operation.

9. An installation according to claim 6, wherein the gas analysis circuit extending from each sampling orifice conduit comprises, a sampling conduit, a valve for controlling the flow of fluid in said sampling conduit, and manifold means which are connected to said sampling conduit and also connected through connecting conduit means to said gas analysis device, and wherein the sampling conduits of a plurality of orifices are connected to said manifold means.

10. An installation according to claim 9, wherein the sampling circuits are grouped into two sub-assemblies, with the sampling conduits of each sub-assembly being connected to a respective manifold means and wherein, two manifold means are provided which are connected through respective connecting conduits to the analysis device under the control of valve means.

11. An installation according to claim 9, further comprising, downstream of the manifold means, at least one filter, a valve disposed on each side of said filter and cleaning means for cleaning said at least one filter.

12. An installation according to claim 11, wherein said cleaning means comprise a circuit supplying neutral gas under pressure.

13. An installation according to claim 9, further comprising, between the manifold means and the gas analysis device, a three-way valve also connected to a calibrated gas circuit for calibrating the gas analysis device.

14. An installation according to claim 6, wherein the pressure measuring circuit comprises a pressure measuring conduit leading from each sampling orifice conduit, said pressure measuring conduit being controlled by a valve and being connected through a main conduit to the pressure measuring device.

15. An installation according to claim 14, comprising, upstream of said valve controlling the pressure measuring conduit, a gas supply conduit connected to the pressure measuring conduit and also connected to a supply of neutral gas under pressure and in which gas supply conduit are inserted a valve and flow controller so as to establish a flow of neutral gas during the pressure measurements and avoid the stopping up of the conduits.

16. An installation according to claim 6, wherein the control device comprises a programmable automaton programmed in such manner as to carry out in sequence the operations for preparing the gas analysis and pressure measuring circuits, for sampling and analysis of gas, and for measuring pressure, the latter operations being considered as having no priority over the preceding operations.

17. An installation according to claim 6, wherein the control device comprises a programmable computer programmed in such manner as to carry out in sequence the operations for preparing the gas analysis and pressure circuits, for sampling and analysis of gas, and for measuring pressure, the latter operations being considered as having no priority over the preceding operations.

18. An installation according to claim 6, comprising a computer connected to receive the measurements carried out and process them in accordance with a given program, this computer also managing the operations for re-calibrating the gas analysis device.

* * * * *